US006231119B1

(12) United States Patent
Zheng

(10) Patent No.: US 6,231,119 B1
(45) Date of Patent: May 15, 2001

(54) FOLDABLE DUAL-CHAIR

(75) Inventor: Edward Zheng, La Verne, CA (US)

(73) Assignee: Tofasco of America, Inc., La Verne, CA (US)

( * ) Notice: Subject to any disclaimer, the term of this patent is extended or adjusted under 35 U.S.C. 154(b) by 0 days.

(21) Appl. No.: 09/662,956

(22) Filed: Sep. 15, 2000

(51) Int. Cl.[7] ..... A47C 15/00
(52) U.S. Cl. ..... 297/16.2; 297/45; 297/232
(58) Field of Search ..... 297/16.1, 16.2, 297/45, 232

(56) References Cited

U.S. PATENT DOCUMENTS 3,492,046 * 1/1970 Wittner et al. ..... 297/45 X
3,640,568 * 2/1972 Suzuki et al. ..... 297/232
5,570,928 * 11/1996 Staunton et al. ..... 297/458
6,082,813 * 7/2000 Chen ..... 297/45 X

* cited by examiner

*Primary Examiner*—Peter R. Brown
(74) *Attorney, Agent, or Firm*—Raymond Y. Chan; David & Raymond Patent Group

(57) ABSTRACT

A foldable dual-chair includes a pair of seat frames and a pair of back frame constructed to support a pair of fabric seats thereon respectively wherein a connecting frame is foldably supported between the two seat frames. The connecting frame includes a pair connecting leg posts each having an outer tube frame and an inner tube frame upwardly extended therefrom in a vertical movable manner. So, the connecting leg posts are capably of slidably adjusting their height in such a manner the foldable dual-chair is capable of folding up into a compact unit for easy storage and carriage.

19 Claims, 6 Drawing Sheets

FOLDABLE DUAL-CHAIR

BACKGROUND OF THE PRESENT INVENTION

1. Field of Invention

The present invention relates to foldable chair, and more particularly to a foldable dual-chair which is facilitated to be folded into a compact unit for storage and carriage.

2. Description of Related Arts

Since a conventional foldable chair can be quickly and easily unfolded for use and folded into a compact unit for carriage, a user can carry the foldable chair to everywhere such as campground or beach. However, when two or more person may join together to have an outdoor activity, they must need to bring more foldable chair in order to occupy their own chair. Even though each foldable chair is folded into a compact size, it is difficult for the user to carry two or more foldable chairs at the same time. Thus, the foldable chairs are bulky for storage and transportation especially when the user put them into a limited space of a vehicle's trunk.

Some improved foldable chairs increase their sizes in order to support two people sitting thereon. However, such foldable chairs have their drawbacks. First, the foldable chair may fail to well support the users because of the increase of user's weight. In order to well support the user, the foldable chair must provide a rigid cross-support structure of the construction tubes that may increase the weight of the foldable chair. Second, more metal tubes are needed to be constructed the foldable chair in order to increase its seat frame section for supporting two persons. However, the foldable chair cannot be folded into a compact unit which is bulky and difficult to carriage.

SUMMARY OF THE PRESENT INVENTION

A main object of the present invention is to provide a foldable dual-chair, which provides a strong frame structure that can well support two users sitting on the foldable dual-chair.

Another object of the present invention is to provide a foldable dual-chair which can be quickly and easily folded into a compact unit for carriage and storage and unfolded for use.

Another object of the present invention is to provide a foldable dual-chair, which has a simple construction that every individual is able to fold and unfold the foldable dual-chair in one single motion.

Accordingly, in order to accomplish the above objects, the present invention provides a foldable dual-chair, comprising a pair of seat frames and a pair of back frame constructed to support a pair of fabric seats thereon respectively.

Each seat frame comprises an inter-side frame leg, an outer-side frame leg, and a construction frame leg foldably supported between the inter-side frame leg and the outer-side frame leg wherein a connecting frame is foldably supported between the two inter-side frame legs. Each of inter-side and outer-side frame legs comprises a front side crossed leg and a rear side crossed leg pivotally connected together where they cross, a front upper frame joint pivotally connected to a top end of the rear side crossed leg, and a front base frame joint pivotally connected to a lower end of the front side crossed leg.

The connecting frame comprises a pair of connecting leg posts slidably passing through the two front frame joints of the two inter-side frame legs respectively wherein each connecting leg post comprises an outer tube frame having a lower end connected to the front base frame joint and an inner tube frame coaxially and upwardly extended from the outer tube frame in a slidably movable manner and penetrating through the respective front upper frame joint.

DETAILED DESCRIPTION OF THE PREFERRED EMBODIMENT

Figure 2:
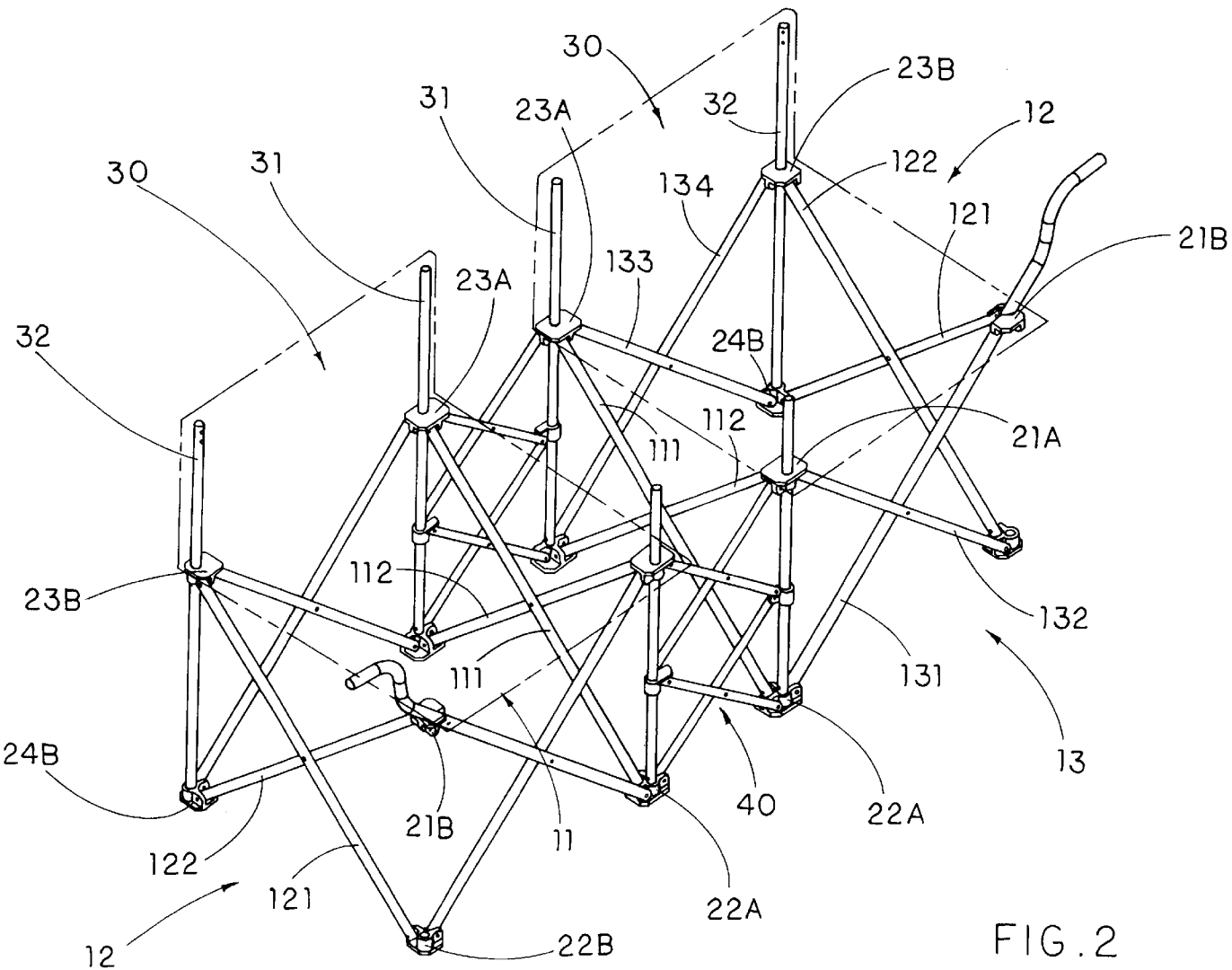
FIG. 2 is a perspective view of a foldable dual-chair according to a preferred embodiment of the present invention.

Referring to FIG. 2 of the drawings, a foldable dual-chair 1 according to a preferred embodiment of the present invention is illustrated, which comprises a pair of seat frames 10 and a pair of back frame 30 constructed to support a pair of fabric seats 1A thereon respectively.

Each seat frame 10 comprises an inter-side frame leg 11 and an outer-side frame leg 12, and a construction frame leg 13 foldably supported between the inter-side frame leg 11 and the outer-side frame leg 12. Each of the inter-side frame leg 11 and the outer-side frame leg 12 comprises a front side crossed leg 111, 121 and a rear side crossed leg 112, 122 pivotally connected together where they cross.

Each seat frame 10 further comprises a front upper inter-frame joint 21A pivotally connected to a top end of the rear side crossed leg 112 of the inter-side frame leg 11, a front upper outer-frame joint 21B pivotally connected to a top end of the rear side crossed leg 122 of the outer-side frame leg 12, a front base inter-frame joint 22A pivotally connected to a lower end of the front side crossed leg 111 of the inter-side frame leg 11, and a front base outer-frame joint 22B pivotally connected to a lower end of the front side crossed leg 121 of the outer-side frame leg 12. Thus, a back upper frame joint 23A, 23B is pivotally connected to a top end of the front side frame leg 111, 121, and a back base frame joint 24A, 24B is pivotally connected to a lower end of the rear lower frame leg 112, 122.

The construction frame leg 13 comprises a pair of front crossed legs 131, 132 pivotally connected together where they cross and a pair of rear crossed legs 133, 134 pivotally connected together where they cross. Four top ends of the front and rear crossed legs 131, 132, 133, 134 are pivotally connected to the two front upper frame joints 21A, 21B and the two rear upper frame joints 23A, 23B respectively. Four lower ends of the front and rear crossed legs 131, 132, 133, 134 are pivotally connected to the two front base frame joints 22A, 22B and the two rear base frame joints 24A, 24B respectively.

Each back frame 30 comprises a pair of back frame legs 31, 32 slidably penetrating through the two rear upper frame joints 23A, 23B of the respective seat frame 10 respectively wherein two lower ends of the two back frame legs 31, 32 are respectively extended downwardly to connect to the two rear base frame joint 24A, 24B.

Figure 5:
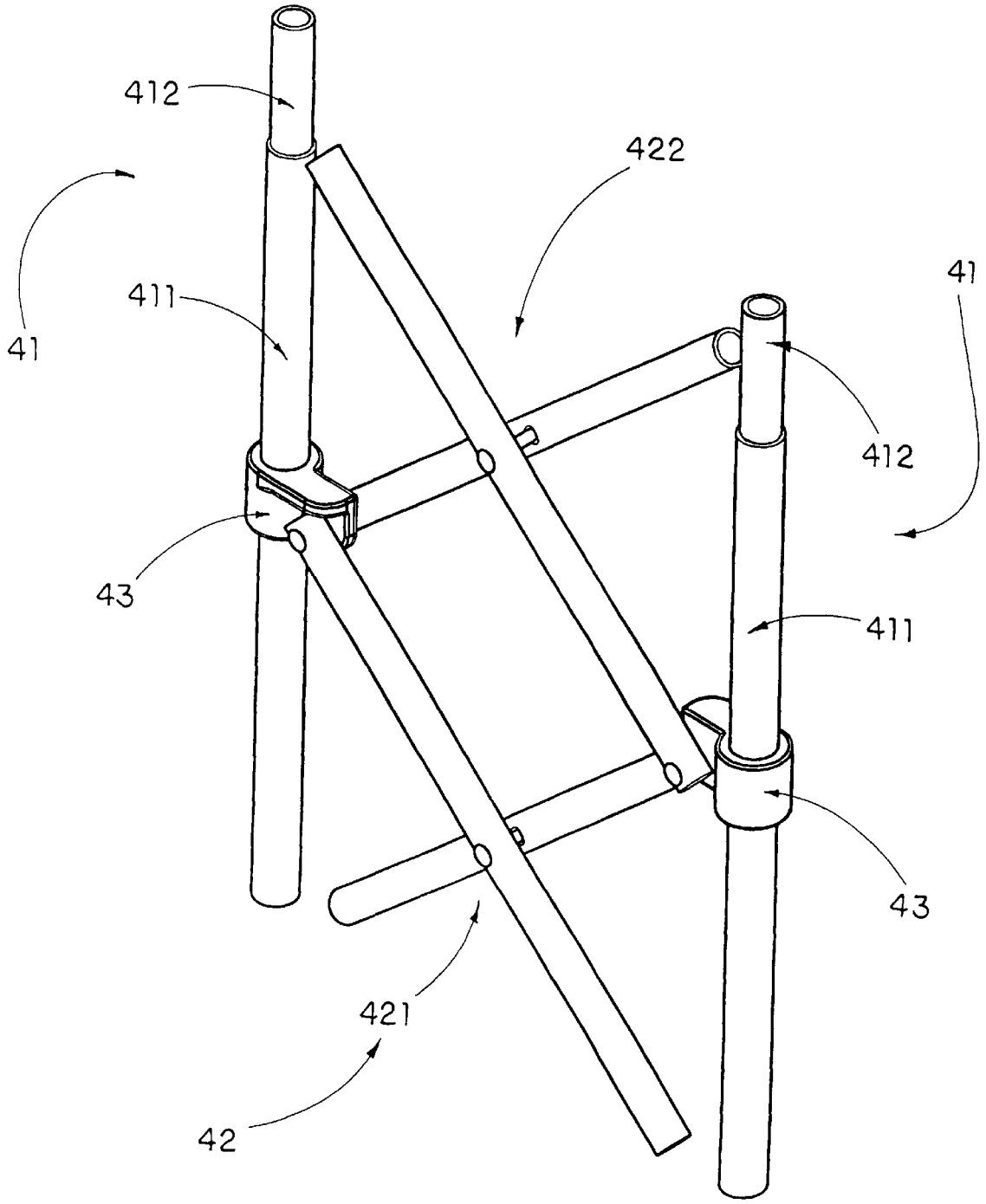
FIG. 5 is a perspective view of a connecting frame of the foldable dual-chair according to the above preferred embodiment of the present invention.

The foldable dual-chair 1 further comprises a connecting frame 40 foldably supported between the two seat frames 10 wherein the connecting frame 40 is pivotally connected between the two inter-side frame legs 11 of the two seat frames 10 respectively. As, shown in FIG. 5, the connecting frame 40 comprises a pair of connecting leg posts 41 each slidably passing the front upper inter-frame joint 21A of the inter-side frame leg 11 of each seat frame 10 wherein each connecting leg post 41 comprises an outer tube frame 411 having a lower end connected to the respective front base joint 22A and an inner tube frame 412 coaxially and upwardly extended from the outer tube frame 411 in a slidably movable manner and slidably passing through the front upper inter-frame joint 21A, wherein the outer tube frame 411 has a diameter larger than a diameter of the inner tube frame 412 such that the inner tube frame 412 is slidably disposed in the outer tube frame 411 in a vertical movable manner. It is worth to mention that the foldable dual-chair 1 is lengthened when it is in a folded state, so that the inner tube frame 412 are capable of increase the height of the connecting leg posts when the inner tube frames 412 are upwardly extended from the outer tube frames 411 respectively. Thus, the inner tube frame 412 is slidably penetrated through a predetermined position of the fabric seat 1A, so as to hold the fabric seat 1A in position when the fabric seat 1A is stretched out in the unfolded state of the foldable dual-chair 1.

Moreover, a stopper 413 is affixed on a top end of each inner tube frame 412, which is positioned above the respective front upper inter-frame joint 21A, for ensuring the respective front upper inter-frame joint 21A slid along the inner tube frame 412 in a folding process.

The foldable dual-chair 1 further comprises a fabric flap 50 foldably supported between two seat frames 10. The fabric flap 50 has a predetermined size and shape wherein one of the respective back frame legs 31 from each back frame 30 is slidably penetrated through a rear end of the fabric flap 50 and a front end of the fabric flap 50 is affixed to the two stoppers 413 of the connecting leg posts 41 in such a manner the fabric flap 50 is adapted to be horizontally and flatly stretched out when the foldable dual-chair 1 in the unfolded state such that the fabric flap 50 is capable of forming an arm rest between the two seat frames 10, so as to support the user's arm when he or she sits on the foldable dual-chair 1. At least a holder 501 such as cup holder is mounted on the fabric flap 50. Moreover, a supplementary fabric extension 51 having at least a pocket provided thereon is frontwardly extended from the front end of the fabric flap 50 for storing the user's accessories.

The connecting frame 40 further comprises two pairs of connecting crossed legs 42 foldably supported between the two seat frames 10 wherein each pair of connecting crossed legs 42 pivotally connected with each other to form a "X" structure. The lower pair of connecting crossed legs 421 have two bottom ends pivotally connected to the two front base inter-frame joints 22A respectively and the upper pair of connecting crossed legs 422 also have two top ends pivotally connected to the two front upper inter-frame joints 21A respectively, wherein the upper and lower pairs of connecting crossed legs 422, 421 are pivotally connected together by a pair of sliding joints 43 which are slidably connected with the connecting leg posts 41 respectively.

Figure 3:
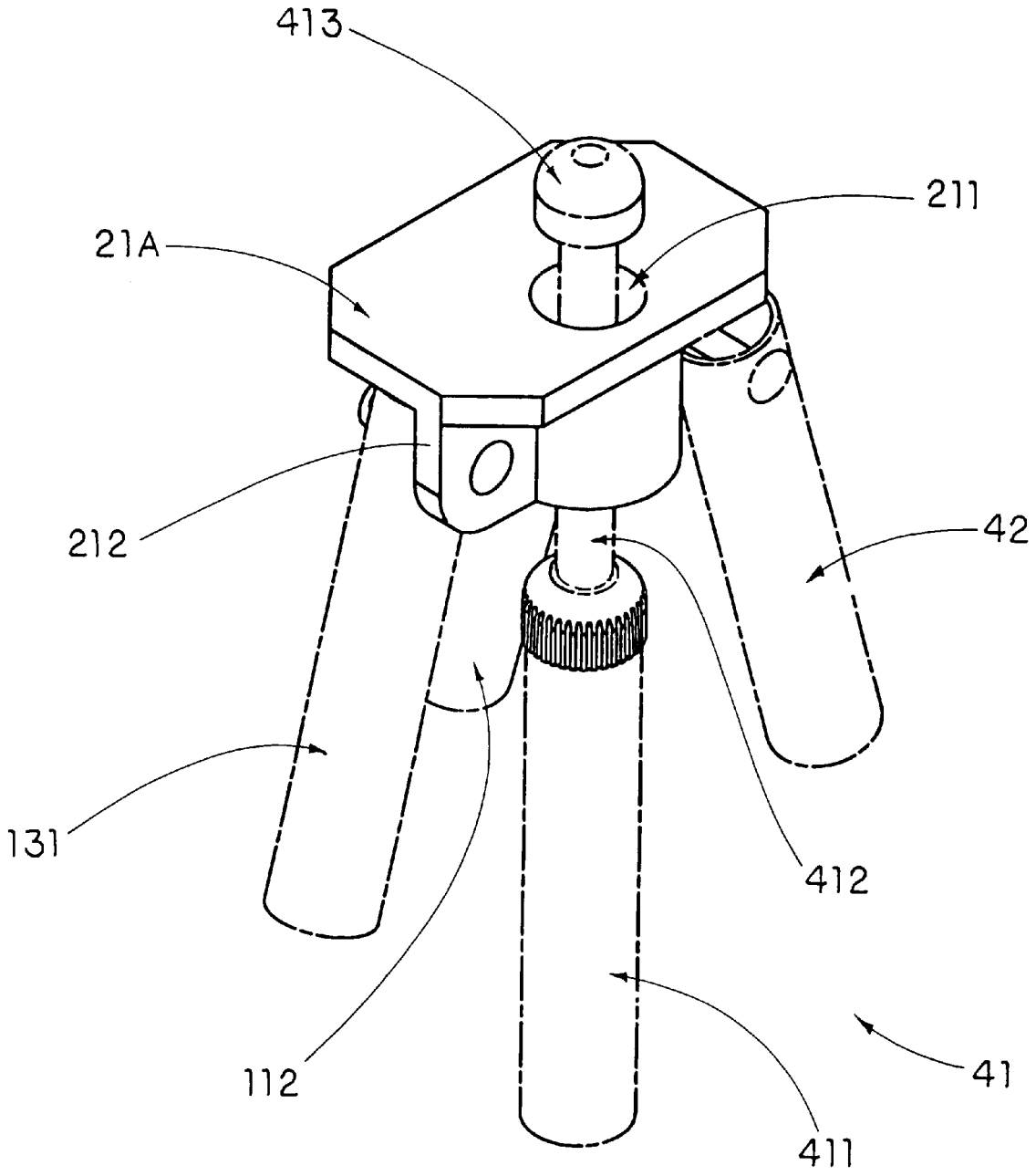
FIG. 3 is a perspective view of a front upper inter-frame joint of the foldable dual-chair according to the above preferred embodiment of the present invention.

According to the preferred embodiment, each of the front upper inter-frame joint 21A has a guiding through hole 211 having a diameter slightly smaller than the respective outer tube frame 411 of the connecting leg post 41 for the inner tube frame 412 of the connecting leg post 41 slidably passing through, as shown in FIG. 3, such that the front upper inter-frame joint 21A is sat on a top end of the respective outer tube frame 411 when the foldable dual-chair 1 is in an unfolded state. In other words, the length of the outer tube frame 411 is the height of the foldable dual-chair 1 in the unfolded state. Each front upper inter-frame joint 21A comprises three walls 212 downwardly and perpendicularly extended therefrom for pivotally connecting the rear side frame leg 112, the front crossed leg 131 of the construction frame leg 13, and the connecting crossed leg 42 of the connecting frame 40 respectively.

Figure 4:
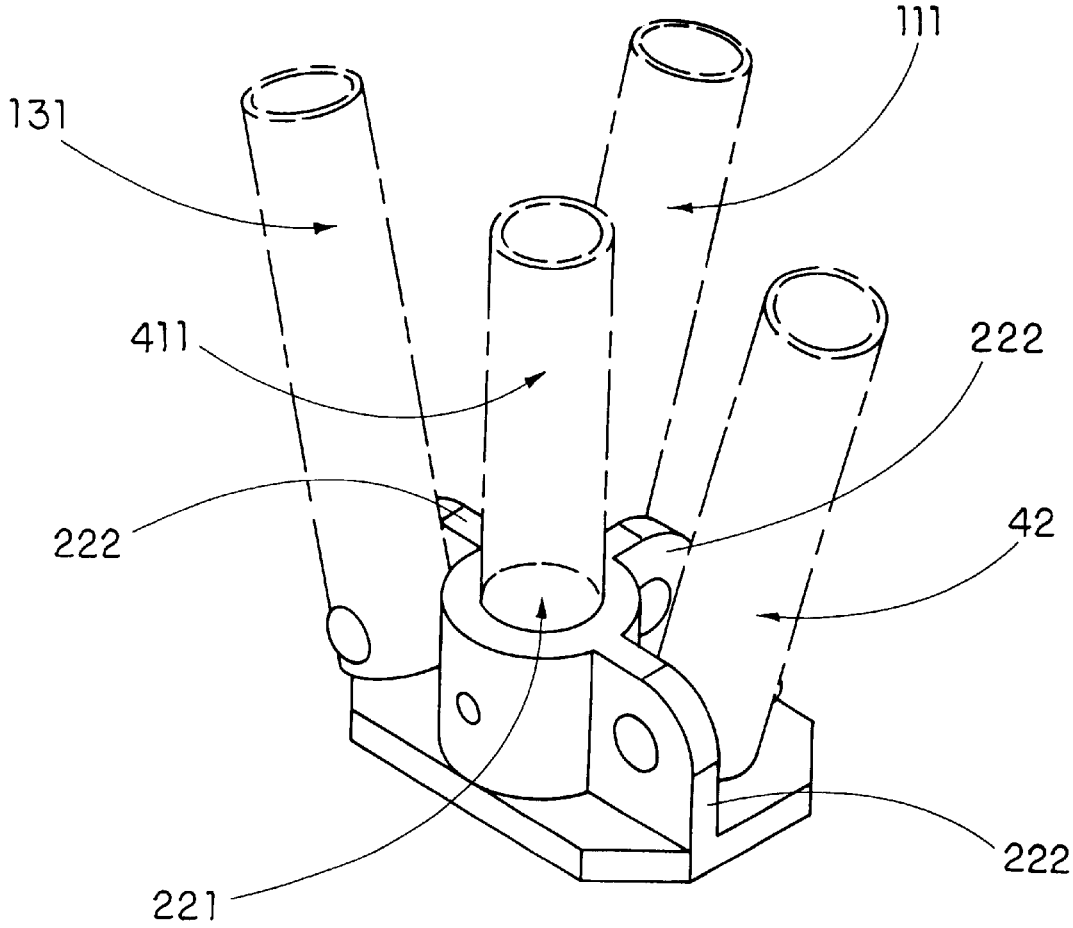
FIG. 4 is a perspective view of a front lower inter-frame joint of the foldable dual-chair according to the above preferred embodiment of the present invention.

As shown in FIG. 4, each front base inter-frame joint 22A has a circular holder 221 having a diameter slightly larger than the respective outer tube frame 411 of the connecting leg post 41 for securely holding the lower end of the connecting leg posts 41. Each front base inter-frame 22A comprises three supporting walls 222 upwardly and perpendicularly extended therefrom for pivotally connecting the front side frame leg 111, the front crossed leg 131 of the construction frame leg 13, and the connecting crossed leg 42 of the connecting frame 40 respectively.

Figure 6:
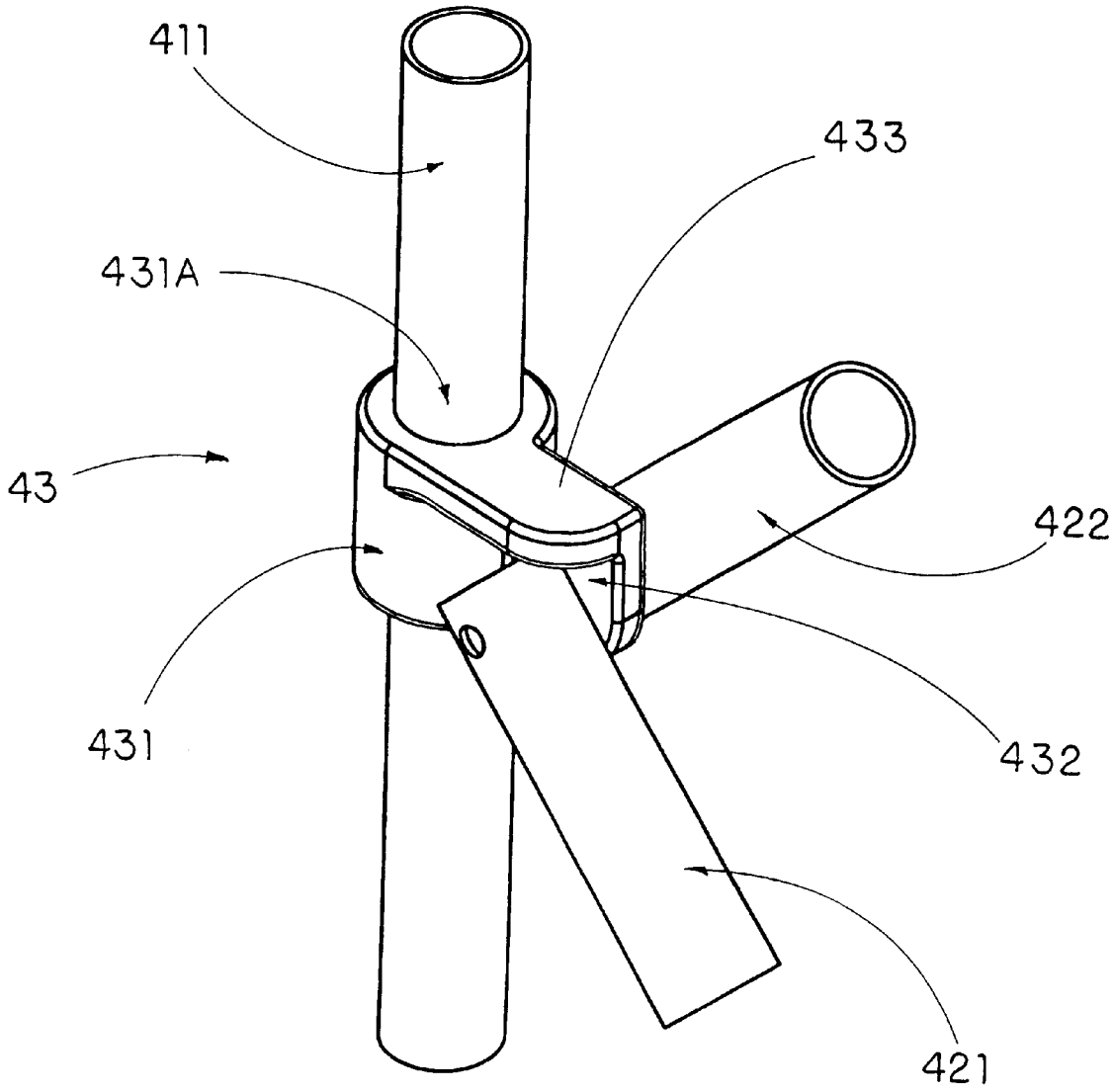
FIG. 6 is a perspective view of a sliding joint of the connecting frame of the foldable dual-chair according to the above preferred embodiment of the present invention.

Referring to FIG. 6, each sliding joint 43 comprises a slider body 431 having a slider hole 431A which has a diameter slightly larger than the respective connecting leg post 41 and vertically extended through the slider body 431 for the respective connecting leg post 41 slidably passing through. Each sliding joint 43 further comprises a pivotal arm 432 integrally extended from the slider body 431 for pivotally connecting both the upper and lower connecting crossed legs 422, 421 together, and an top wall 433 integrally and perpendicularly extended on a top of the pivotal arm 432 so as to limit the rotation angle of the lower pair of connecting crossed legs 421.

It is worth to mention that two pairs of connecting crossed legs 42 is used instead of a pair of connecting crossed legs because the pairs of connecting crossed legs 42 can provide a better rotation angle thereof. Thus, the two pairs of connecting crossed legs 42 are slidably connected with the two connecting leg posts 41 so as to provide better support between the two seat frames 10.

When the foldable dual-chair 1 is folded, each side frame leg 11, 12 and the connecting crossed legs 42 will rotate to narrow the cross structure thereof to near vertical position, as the circumference of the foldable dual-chair 1 is reduced and the height is lengthened. So, the two front upper inter-frame joints 21A are rendered to move upwardly by the seat frames 10, so as to upwardly slide along the inner tube frame 412 of the connecting leg posts 41 respectively by pushing the stopper 43 upward. When the foldable dual-chair 1 is in unfolded state, the front upper inter-frame joints 21A are downwardly slid along the two inner tube frame 412 and sat on top ends of the respective outer tube frames 411 of the connecting leg posts 41 respectively for partially supporting the foldable dual-chair 1. In other words, the inner tube frames 412 will respectively guide the two front upper inter-frame joints 21A in a vertical movable manner.

In order to rigidly support the two seat frame 10 together, as shown in FIG. 2, the connecting frame 40 further comprises two pairs of additional connecting crossed legs 44 foldably supported between the two rear upper frame joints 23A and the two rear base frame joints 24A of the inter-side frame leg 11 wherein each pair of additional connecting crossed legs 44 pivotally connected each other to form a "X"

structure. The lower pair of additional connecting crossed legs 441 have two bottom ends pivotally connected to the two rear frame joints 24A respectively and the upper pair of additional connecting crossed legs 442 also have two top ends pivotally connected to the two rear upper frame joints 23A respectively, wherein the upper and lower pairs of additional connecting crossed legs 442, 441 are pivotally connected together by two sliding joints 43 which are slidably connected with the back frame legs 31 of the back frames 30 respectively.

What is claimed is:

1. A foldable dual-chair, comprising:

a pair of seat frames and a pair of back frame constructed to support a pair of fabric seats thereon respectively wherein each seat frame comprises an inter-side frame leg, an outer-side frame leg, and a construction frame leg foldably supported between the inter-side frame leg and the outer-side frame leg, each of said inter-side and outer-side frame legs comprising a front side crossed leg and a rear side crossed leg pivotally connected together where they cross, a front upper inter-frame joint pivotally connected to a top end of said rear side crossed leg, and a front base inter-frame joint pivotally connected to a lower end of said front side crossed leg, and a connecting frame, foldably supported between said two inter-side frame legs of said pair of seat frame, comprising a pair of connecting leg posts slidably passing through said two front upper inter-frame joints of said two inter-side frame legs respectively, each said connecting leg post comprising an outer tube frame having a lower end connected to said front base inter-frame joint and an inner tube frame coaxially and upwardly extended from said outer tube frame in a slidably movable manner and penetrating through said respective front upper inter-frame joint.

2. A foldable dual-chair, as recited in claim 1, wherein said connecting frame further comprises two pairs of connecting crossed legs foldably supported between the two seat frames wherein each pair of connecting crossed legs pivotally connected with each other to form a "X" structure.

3. A foldable dual-chair, as recited in claim 2, wherein said connecting frame further comprises a stopper affixed on a top end of each said inner tube frame of said connecting leg post, which is positioned on top of said respective front upper inter-frame joint, for ensuring said respective front upper inter-frame joint slid along said inner tube frame in a folding process.

4. A foldable dual-chair, as recited in claim 3, wherein said outer tube frame of said connecting leg post has a diameter larger than a diameter of said inner tube frame thereof such that said inner tube frame is slidably disposed in said outer tube frame in a vertical movable manner.

5. A foldable dual-chair, as recited in claim 4, wherein said two pairs of connecting crossed legs comprises a lower pair of connecting crossed legs having two bottom ends pivotally connected to said two front base inter-frame joints respectively and an upper pair of connecting crossed legs having two top ends pivotally connected to said two front upper inter-frame joints respectively, wherein said upper and lower pairs of connecting crossed legs are pivotally connected together by a pair of sliding joints which are slidably connected with said connecting leg posts respectively.

6. A foldable dual-chair, as recited in claim 5, wherein each said sliding joint comprises a slider body having a slider hole which has a diameter slightly larger than said respective connecting leg post and vertically extended through said slider body for said respective connecting leg post slidably passing through, and a pivotal arm integrally extended from said slider body for pivotally connecting both said upper and lower connecting crossed legs together.

7. A foldable dual-chair, as recited in claim 6, wherein said each of said front upper inter-frame joint has a guiding through hole having a diameter slightly smaller than said respective outer tube frame of said connecting leg post for said inner tube frame of said connecting leg post slidably passing through.

8. A foldable dual-chair, as recited in claim 6, wherein said connecting frame further comprises an upper pair of additional connecting crossed legs and a lower pair of additional connecting crossed legs, each of which are pivotally connected each other to form a "X" structure, wherein said upper pair of additional connecting crossed legs having two top ends pivotally connected to two rear upper frame joints respectively and said lower pair of additional connecting crossed legs having two bottom ends pivotally connected to two rear frame joints respectively, and wherein said upper and lower pairs of additional connecting crossed legs are pivotally connected together by two said sliding joints which are slidably connected with said back frame legs of said back frames respectively.

9. A foldable dual-chair, as recited in claim 5, wherein said each of said front upper inter-frame joint has a guiding through hole having a diameter slightly smaller than said respective outer tube frame of said connecting leg post for said inner tube frame of said connecting leg post slidably passing through.

10. A foldable dual-chair, as recited in claim 5, wherein said connecting frame further comprises an upper pair of additional connecting crossed legs and a lower pair of additional connecting crossed legs, each of which are pivotally connected each other to form a "X" structure, wherein said upper pair of additional connecting crossed legs having two top ends pivotally connected to two rear upper frame joints respectively and said lower pair of additional connecting crossed legs having two bottom ends pivotally connected to two rear frame joints respectively, and wherein said upper and lower pairs of additional connecting crossed legs are pivotally connected together by two said sliding joints which are slidably connected with said back frame legs of said back frames respectively.

11. A foldable dual-chair, as recited in claim 5, further comprises a fabric flap having a predetermined shape and size foldably supported between said two seat frames wherein a rear end of said fabric flap is slidably connected to said back frames and a front end of said fabric flap is affixed to said two stoppers of said connecting leg posts in such a manner said fabric flap is adapted to be horizontally and flatly stretched out when said foldable dual-chair in an unfolded state such that said fabric flap is capable of forming an arm rest between said two seat frames, so as to support users' arms while sitting on said foldable dual-chair.

12. A foldable dual-chair, as recited in claim 5, further comprises a fabric flap having a predetermined shape and size foldably supported between said two seat frames wherein a rear end of said fabric flap is slidably connected to said back frames and a front end of said fabric flap is affixed to said two stoppers of said connecting leg posts in such a manner said fabric flap is adapted to be horizontally and flatly stretched out when said foldable dual-chair in an unfolded state such that said fabric flap is capable of forming an arm rest between said two seat frames, so as to support users' arms while sitting on said foldable dual-chair.

13. A foldable dual-chair, as recited in claim 4, wherein said each of said front upper inter-frame joint has a guiding through hole having a diameter slightly smaller than said respective outer tube frame of said connecting leg post for said inner tube frame of said connecting leg post slidably passing through.

14. A foldable dual-chair, as recited in claim 3, wherein said two pairs of connecting crossed legs comprises a lower pair of connecting crossed legs having two bottom ends pivotally connected to said two front base inter-frame joints respectively and an upper pair of connecting crossed legs having two top ends pivotally connected to said two front upper inter-frame joints respectively, wherein said upper and lower pairs of connecting crossed legs are pivotally connected together by a pair of sliding joints which are slidably connected with said connecting leg posts respectively.

15. A foldable dual-chair, as recited in claim 14, wherein each said sliding joint comprises a slider body having a slider hole which has a diameter slightly larger than said respective connecting leg post and vertically extended through said slider body for said respective connecting leg post slidably passing through, and a pivotal arm integrally extended from said slider body for pivotally connecting both said upper and lower connecting crossed legs together.

16. A foldable dual-chair, as recited in claim 2, wherein said outer tube frame of said connecting leg post has a diameter larger than a diameter of said inner tube frame thereof such that said inner tube frame is slidably disposed in said outer tube frame in a vertical movable manner.

17. A foldable dual-chair, as recited in claim 2, wherein said two pairs of connecting crossed legs comprises a lower pair of connecting crossed legs having two bottom ends pivotally connected to said two front base inter-frame joints respectively and an upper pair of connecting crossed legs having two top ends pivotally connected to said two front upper inter-frame joints respectively, wherein said upper and lower pairs of connecting crossed legs are pivotally connected together by a pair of sliding joints which are slidably connected with- said connecting leg posts respectively.

18. A foldable dual-chair, as recited in claim 17, wherein each said sliding joint comprises a slider body having a slider hole which has a diameter slightly larger than said respective connecting leg post and vertically extended through said slider body for said respective connecting leg post slidably passing through, and a pivotal arm integrally extended from said slider body for pivotally connecting both said upper and lower connecting crossed legs together.

19. A foldable dual-chair, as recited in claim 1, wherein said connecting frame further comprises a stopper affixed on a top end of each said inner tube frame of said connecting leg post, which is positioned on top of said respective front upper inter-frame joint, for ensuring said respective front upper inter-frame joint slid along said inner tube frame in a folding process.

* * * * *

US006231119C1

(12) EX PARTE REEXAMINATION CERTIFICATE (5394th)

United States Patent
Zheng

(10) Number: US 6,231,119 C1
(45) Certificate Issued: Jun. 6, 2006

(54) FOLDABLE DUAL-CHAIR

(75) Inventor: Edward Zheng, La Verne, CA (US)

(73) Assignee: Tofasco of America, Inc., La Verne, CA (US)

Reexamination Request:
No. 90/006,935, Feb. 12, 2004

Reexamination Certificate for:

| | |
|---|---|
| Patent No.: | **6,231,119** |
| Issued: | **May 15, 2001** |
| Appl. No.: | **09/662,956** |
| Filed: | **Sep. 15, 2000** |

(51) Int. Cl.
*A47C 15/00* (2006.01)

(52) U.S. Cl. ..... 297/16.2; 297/45; 297/232
(58) Field of Classification Search ..... None
See application file for complete search history.

(56) References Cited

U.S. PATENT DOCUMENTS 4,008,918 A 2/1977 Cooper et al.
D437,145 S 2/2001 Leng
6,193,308 B1 2/2001 Hwang
6,247,749 B1 6/2001 Yu
6,435,112 B1 8/2002 Insalaco

OTHER PUBLICATIONS

Figure 1:
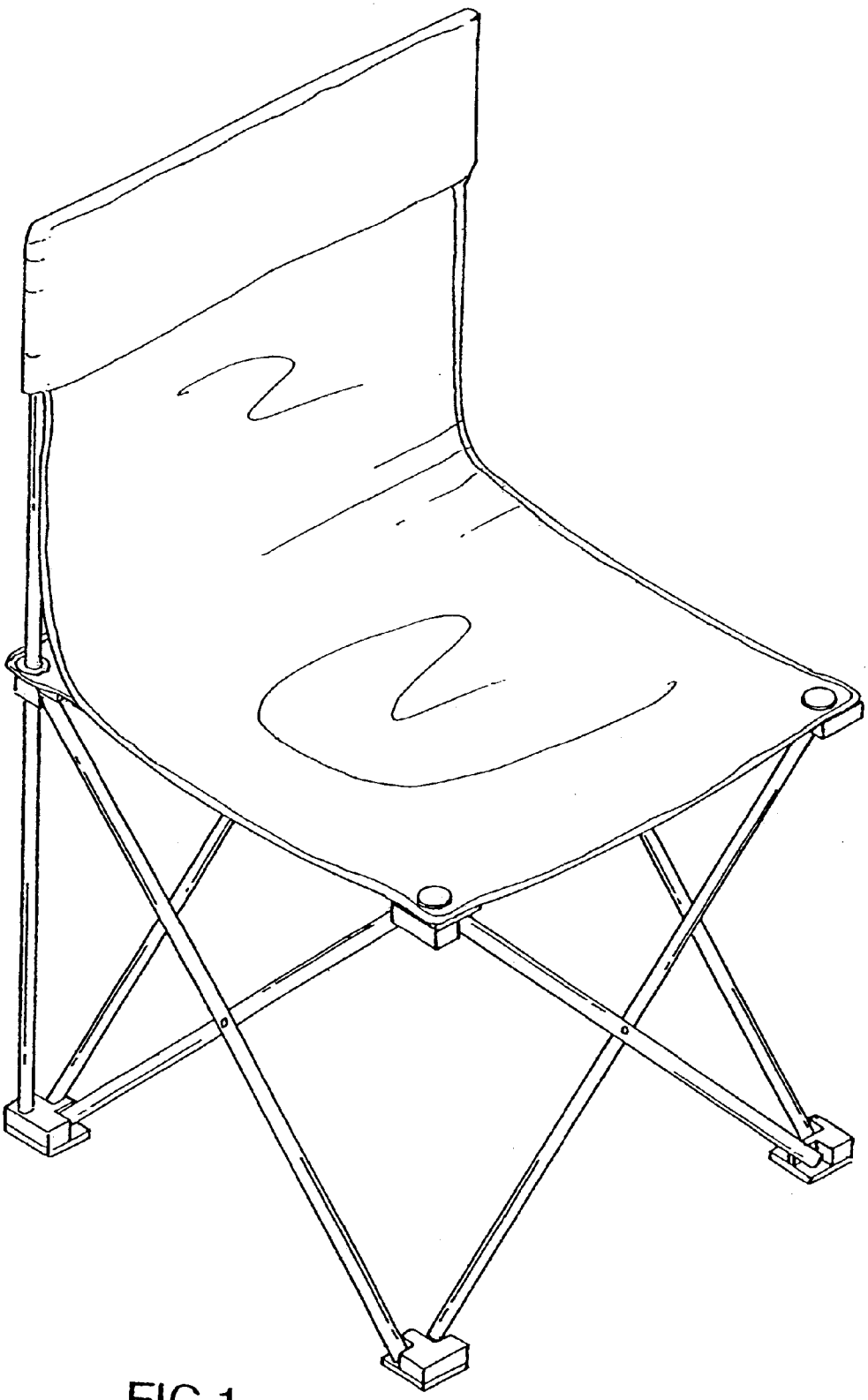
FIG 1 Prior Art
FIG. 1 is a perspective view of a conventional folding chair.

Taiwanese Patent Document, dated Dec. 14, 1982, Figs 1 and 2.

*Primary Examiner*—Laurie K. Cranmer

(57) ABSTRACT

A foldable dual-chair includes a pair of seat frames and a pair of back frame constructed to support a pair of fabric seats thereon respectively wherein a connecting frame is foldably supported between the two seat frames. The connecting frame includes a pair connecting leg posts each having an outer tube frame and an inner tube frame upwardly extended therefrom in a vertical movable manner. So, the connecting leg posts are capably of slidably adjusting their height in such a manner the foldable dual-chair is capable of folding up into a compact unit for easy storage and carriage.

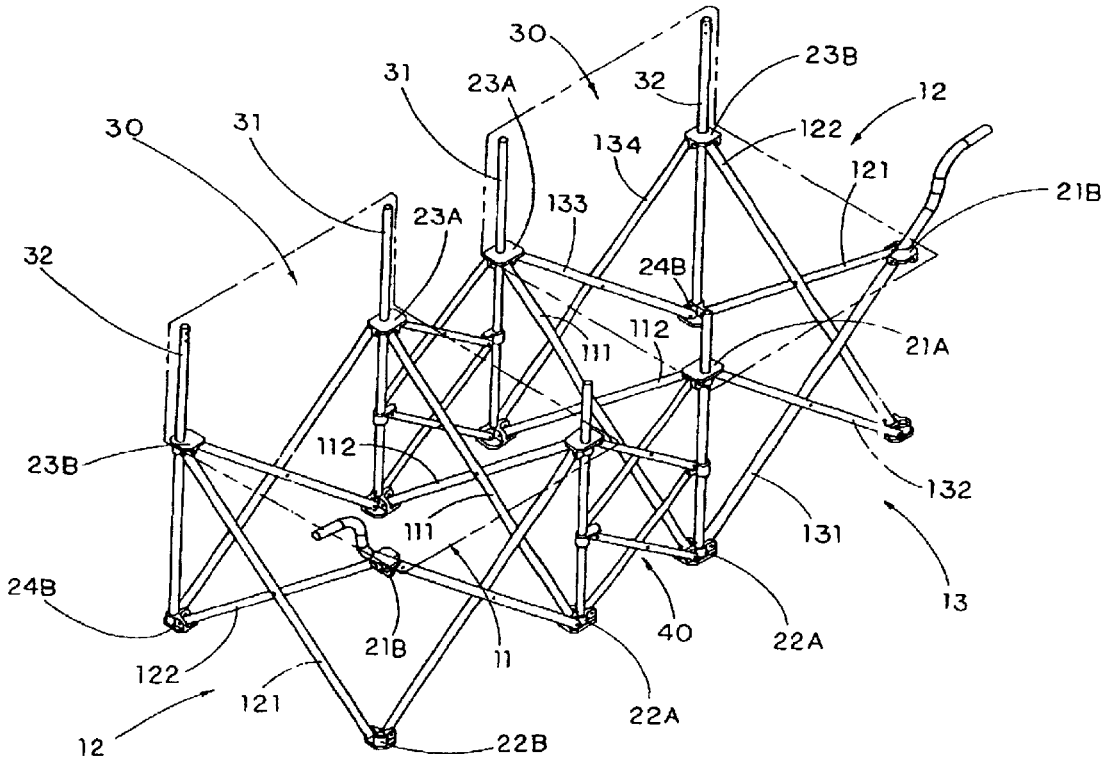

EX PARTE REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1–19 is confirmed.

* * * * *